US009118102B2

(12) United States Patent
Konda et al.

(10) Patent No.: US 9,118,102 B2
(45) Date of Patent: Aug. 25, 2015

(54) NON-RECIPROCAL CIRCUIT ELEMENT

(75) Inventors: Junji Konda, Tokyo (JP); Daisuke Mabuchi, Tokyo (JP)

(73) Assignee: ORIENT MICROWAVE CORPORATION, Osaka (JP)

( * ) Notice: Subject to any disclaimer, the term of this patent is extended or adjusted under 35 U.S.C. 154(b) by 162 days.

(21) Appl. No.: 13/996,727

(22) PCT Filed: Dec. 22, 2011

(86) PCT No.: PCT/JP2011/007194

§ 371 (c)(1),
(2), (4) Date: Jun. 21, 2013

(87) PCT Pub. No.: WO2012/095933

PCT Pub. Date: Jul. 19, 2012

(65) Prior Publication Data

US 2013/0285759 A1 Oct. 31, 2013

(30) Foreign Application Priority Data

Jan. 14, 2011 (JP) ..... 2011-005729
Feb. 18, 2011 (JP) ..... 2011-033034

(51) Int. Cl.
*H01P 1/387* (2006.01)
*H01P 1/38* (2006.01)

(52) U.S. Cl.
CPC . *H01P 1/38* (2013.01); *H01P 1/387* (2013.01)

(58) Field of Classification Search
CPC ..... H01P 1/32; H01P 1/38; H01P 1/383; H01P 1/387
USPC ..... 333/1.1, 24.2
See application file for complete search history.

(56) References Cited

FOREIGN PATENT DOCUMENTS

| | | |
|---|---|---|
| JP | 2003-133813 | 5/2003 |
| JP | 2005-080087 | 3/2005 |

OTHER PUBLICATIONS

International Search Report mailed Mar. 19, 2012 in International (PCT) Application No. PCT/JP2011/007194.

*Primary Examiner* — Stephen E Jones
(74) *Attorney, Agent, or Firm* — Wenderoth, Lind & Ponack, L.L.P.

(57) ABSTRACT

A non-reciprocal circuit element, such as an isolator or a circulator, which is incorporated in various microwave devices and rotationally changes a transmission path for microwaves by a gyromagnetic effect. The non-reciprocal circuit element has a simple structure and superiority in assembly and allows easy achievement of height reduction and size reduction while preventing fracture of a ferrite plate.

7 Claims, 9 Drawing Sheets

TEMPERATURE CHANGE BEHAVIOR
-·-·- LOW TEMPERATURE SIDE(-40℃)※SMALL GAP
——— ORDINARY TEMPERATURE(+25℃)
····· HIGH TEMPERATURE SIDE(+85℃)※LARGE GAP

TEMPERATURE CHANGE BEHAVIOR
-·-·- LOW TEMPERATURE SIDE(-40℃)※MAGNETIC FLUX DENSITY: INCREASE
——— ORDINARY TEMPERATURE(+25℃)
····· HIGH TEMPERATURE SIDE(+85℃)※MAGNETIC FLUX DENSITY: DECREASE

NON-RECIPROCAL CIRCUIT ELEMENT

TECHNICAL FIELD

The present invention relates to a non-reciprocal circuit element, such as an isolator or a circulator, which is incorporated in various microwave devices and rotationally changes a transmission path for microwaves by a gyromagnetic effect.

BACKGROUND ART

Generally, non-reciprocal circuit elements such as an isolator and a circulator are mounted on circuit boards of microwave devices such as a microwave amplifier and a microwave oscillator. In such non-reciprocal circuit elements, a magnetic field in one direction is provided by a permanent magnet into a magnetic body of, e.g., ferrite for causing microwaves to magnetically resonate, a central conductor including I/O terminals is arranged at a surface of the magnetic body, and a transmission path for microwaves input from one of the I/O terminals is rotationally changed to another one according to the right-handed screw rule invoked by a gyromagnetic effect.

With the recent reduction in size and weight of circuit boards of microwave devices as described above, there is a need for development of a small thin one which has a simpler structure and superiority in assembly compared with a conventional one and can be directly placed and mounted on a circuit board, among non-reciprocal circuit elements of this type.

Under the circumstances, the present inventors have proposed, in Patent Literature 1 below, a non-reciprocal circuit element including a central conductor with radially branched I/O terminals, upper and lower ferrite plates facing each other with the central conductor therebetween, and upper and lower conductor plates facing each other with the upper and lower ferrite plates therebetween and having a magnet arranged on an upper surface of the upper conductor plate which applies a magnetic field to the upper and lower ferrite plates in a fixed direction, wherein hole portions are provided at positions, facing the I/O terminals of the central conductor, of the lower ferrite plate, notches are formed at positions, facing the hole portions, of the lower conductor plate, the I/O terminals of the central conductor are inserted in the hole portions, drawn to the rear side, and bent, and the upper and lower conductor plates are connected to each other by side walls to form a closed magnetic circuit.

According to the non-reciprocal circuit element with the above-described configuration, the I/O terminals of the central conductor are substantially flush with a rear surface of the lower conductor plate, which allows the element to be directly placed and surface-mounted on a circuit board. Additionally, the non-reciprocal circuit element needs only provision of hole portions in the lower ferrite plate and is simple in configuration. The non-reciprocal circuit element has the advantages of a smaller number of components and easier assembly.

CITATION LIST

Patent Literature

Patent Literature 1: Japanese Patent Laid-Open No. 2005-80087

SUMMARY OF THE INVENTION

Problems to be Solved by the Invention

In the conventional non-reciprocal circuit element, however, a large number of long and narrow openings, such as the hole portions in which the I/O terminals are to be inserted and holes through which side walls for connecting the upper and lower conductor plates to form the closed magnetic circuit are to pierce, are formed in the sheet-like brittle lower ferrite plate. This configuration suffers from the problems below. Machining of the openings is difficult and requires higher production costs. If bending stress acts on or warpage occurs in the circuit board after the non-reciprocal circuit element is surface-mounted, fractures are likely to occur starting at rims of the openings.

In order to implement surface mounting of a component, it is essential for the component to have sufficient resistance to bending stress acting on a circuit board when the component is mounted. In contrast, in order to achieve height reduction, upper and lower conductor plates with upper and lower ferrite plates sandwiched therebetween need to be thin, which results in a structure more likely to be deformed by bending stress as described above. There is thus a need to solve the above-described problem.

The conventional non-reciprocal circuit element is configured such that the upper and lower conductor plates connected by the side walls coordinate with each other to form the closed magnetic circuit. For application of the non-reciprocal circuit element to higher frequencies, a magnetic field generated at the upper and lower ferrite plates by the magnet needs to be strengthened.

However, simple increase of the magnetic field strength of the magnet for strengthening the magnetic field at the upper and lower ferrite plates causes degradation of circulator characteristics, and an available frequency band is limited by the limit of the residual magnetic flux density (magnetization intensity) of the magnet. Additionally, the increase in magnetic field strength causes the problems of increasing the size of the magnet and running counter to the demand for reduction in the height of surface mount devices.

The present invention has been made in consideration of the above-described circumstances and has an object to provide a non-reciprocal circuit element which has a simple structure and superiority in assembly and allows easy achievement of height reduction and size reduction while preventing fracture of a ferrite plate.

The present invention also has an object to provide a non-reciprocal circuit element which can obtain good circular characteristics without excessively increasing the magnetic field strength of a magnet and can be used in a wide band including a high frequency band in particular.

Means for Solving the Problems

First Embodiment of the Invention

In order to achieve the above-described object, according to the invention, in a non-reciprocal circuit element in which a central conductor in the form of a flat plate in which respective resonators extending outward are formed between I/O terminals extending outward and radially from a central portion in three directions, upper and lower ferrite plates between which the central conductor together with the resonators is sandwiched, and upper and lower magnetic metal plates between which the upper and lower ferrite plates are sandwiched are stacked, a magnet is arranged on the upper magnetic metal plate, and the upper and lower magnetic metal plates form a closed magnetic circuit via a side plate, bent portions which are bent in out-of-plane directions and form an interstice between the central conductor and the upper ferrite plate and/or the lower ferrite plate are formed at respective distal end portions of the resonators of the central conductor such that the upper ferrite plate and/or the lower ferrite plate is provided to be capable of coming into and out of contact with the central conductor due to elasticity of the bent portions.

According to another aspect of the invention, the distal end portion of each of the resonators is formed in a T-shape by including protruding portions which protrude in two directions orthogonal to a direction in which the resonator extends outward, and the bent portion is formed by bending a proximal end portion of each of the protruding portions.

According to another aspect of the invention, the central conductor is made of a copper-based non-magnetic metal plate.

According to another aspect of the invention, a distal end portion of each of the I/O terminals is formed in a T-shape by including protruding portions which protrude in two directions orthogonal to a direction in which the I/O terminal extends outward, and a second bent portion which cooperates with the bent portions is formed by bending a proximal end portion of each of the protruding portions.

Second Embodiment of the Invention

Additionally, in order to achieve the above-described object, in a non-reciprocal circuit element in which a central conductor in the form of a flat plate which includes integrally formed I/O terminals extending outward and radially from a central portion in three directions and functions as a resonator, upper and lower ferrite plates between which the central conductor is sandwiched, and upper and lower magnetic metal plates between which the upper and lower ferrite plates are sandwiched are stacked, a magnet is arranged on the upper magnetic metal plate, and the upper and lower magnetic metal plates form a closed magnetic circuit via a side plate, the upper magnetic metal plate is formed of a material having magnetic permeability lower than magnetic permeability of pure iron and/or is formed to have a thickness smaller than a thickness of the lower magnetic metal plate.

According to another aspect of the invention, the upper magnetic metal plate is formed of magnetic stainless steel.

According to another aspect of the invention, at least a part of a peripheral portion of the magnet is made to protrude outward from a peripheral edge of the upper magnetic metal plate and directly face the upper ferrite plate by making an outer dimension of at least a part of the peripheral edge of the upper magnetic metal plate smaller than outer dimensions of the upper ferrite plate and the magnet.

In contrast, according to another aspect of the invention, a notch extending toward a center of the upper magnetic metal plate is formed in the peripheral portion of the upper magnetic metal plate such that a part corresponding to the notch of the magnet directly faces the upper ferrite plate via the notch.

Additionally, according to another aspect of the invention, an opening is formed in a central portion of the upper magnetic metal plate such that a central portion corresponding to the opening of the magnet directly faces the central portion of the upper ferrite plate via the opening.

Advantages of the Invention

Advantageous Effects of First Embodiment

According to the present invention, the bent portions bent in the out-of-plane directions are formed at the distal end portions of the resonators of the central conductor, the interstice is formed between the central conductor and the upper ferrite plate and/or the lower ferrite plate, and the upper ferrite plate and/or the lower ferrite plate is provided to be capable of coming into and out of contact with the central conductor due to the elasticity of the bent portions. For this reason, even if bending stress acts on a circuit board after the non-reciprocal circuit element is mounted to cause warpage, the warpage can be absorbed in the interstice by elastic deformation of the bent portions.

As a result, fracture of the upper and lower ferrite plates and the like is prevented by the flexibility even in the presence of bending stress acting on the circuit board after the mounting, which allows achievement of height reduction by thinning of the upper and lower magnetic metal plates. It is thus possible to easily achieve height reduction and size reduction.

Additionally, errors in the thickness dimensions of the upper and lower ferrite plates generated at the time of machining can be absorbed by finely adjusting the dimension of the interstice. Thus, processing margins are secured, which leads to superiority in mass productivity. It is also possible to change or finely adjust a center frequency by changing the capacitances between the resonators of the central conductor and the components above and below the central conductor by appropriate prior adjustment of the dimension of the interstice.

Generally, the magnet and the upper and lower magnetic metal plates have the property of decreasing in magnetic field strength (magnetic flux density) with increase in temperature. For this reason, in the non-reciprocal circuit element with the above-described configuration, the center frequency tends to be shifted toward the low frequency side with increase in temperature.

In contrast, in the non-reciprocal circuit element, the dimension of the interstice increases due to thermal elongation of the side plate made of magnetic metal with increase in temperature. As a result of the increase in the interstice, the capacitances between the resonators and the components decrease, which shifts the center frequency toward the high frequency side.

For this reason, in the non-reciprocal circuit element according to the first embodiment of the present invention, in the event of a temperature change, change in center frequency resulting from change in the magnetic field strengths of the magnet and the upper and lower magnetic metal plates described above and change in center frequency resulting from change in the dimension of the interstice due to thermal elongation of the side plate cancel each other out. This allows achievement of superior temperature characteristics.

Note that the bent portions at the distal end portions of the resonators for forming the interstice can take various forms as long as an interstice can be formed between the central conductor and the upper ferrite plate and/or the lower ferrite plate. For example, if the distal end portion of each of the resonators is formed in a T-shape, and proximal end portions of protruding portions of the distal end portion are bent, an interstice can be stably formed between the central conductor and the upper ferrite plate and/or the lower ferrite plate without degrading characteristics of the resonators.

Since the central conductor needs to be a non-magnetic metal conductor, and the bent portions need to have a predetermined modulus of elasticity to function as spring members, the central conductor is preferably formed of a plate of a copper-based non-magnetic metal, such as phosphor bronze, beryllium copper, or pure copper.

The second bent portions that cooperate with the bent portions of the resonators can be formed at the distal end portions of the three I/O terminals that each extend radially between adjacent ones of the resonators, in addition to the bent portions at the distal end portions of the three resonators.

For this reason, the central conductor abuts on the upper ferrite plate and/or the lower ferrite plate in six spots (more precisely, six spots×2=12 points) in a circumferential direction.

As a result, the invention can more reliably form the interstice that is uniform in the circumferential direction. This allows achievement of more stable frequency characteristics. The invention can also eliminate the causes of variations in return loss characteristics and isolation characteristics and stabilize the characteristics.

Advantageous Effects of Second Embodiment

According to the present invention, the closed magnetic circuit formed by the upper and lower magnetic metal plates and the side plate holds magnetism from the magnet, and the upper magnetic metal plate, on which the magnet is placed, is formed of the material having the magnetic permeability lower than the magnetic permeability of pure iron and/or is formed to have the thickness smaller than the thickness of the lower magnetic metal plate. This can make the strength of a leakage magnetic field propagated from the magnet to the upper ferrite plate through the upper magnetic metal plate higher than a conventional configuration.

Additionally, the magnetic field together with a magnetic field supplied from the upper magnetic metal plate via the side plate is uniformly distributed over the resonators in the central conductor. This allows obtainment of a good magnetic moment phenomenon. In addition, since the magnet is placed on the upper magnetic metal plate, i.e., outside the closed magnetic circuit, the upper and lower ferrite plates have different magnetic field strength distributions. This results in a difference between the resonance frequencies at the upper and lower ferrite plates, which allows increase of a fractional band width.

For this reason, good circulator characteristics can be obtained without excessively increasing the magnetic field strength of the magnet, and the non-reciprocal circuit element can be used in a wide band including a high frequency band in particular. Additionally, since the upper magnetic metal plate is formed of the material having the magnetic permeability lower than the magnetic permeability of pure iron, such as magnetic stainless steel, and/or is reduced in thickness, it is possible to easily respond to a demand for further reduction in the size and weight of surface mount devices.

If the upper magnetic metal plate is formed of magnetic stainless steel, the upper magnetic metal plate can more stably resist deformation such as warpage due to its elasticity without causing fracture. Magnetic stainless steel is thus suitable from the standpoint of mechanical strength.

Since a part of the magnet is made to directly face the upper ferrite plate, a leakage magnetic field through the upper magnetic metal plate can be further strengthened. This allows use in a higher frequency band. The invention can achieve expansion of an operation frequency range.

DETAILED DESCRIPTION

First Embodiment

Figure 1:
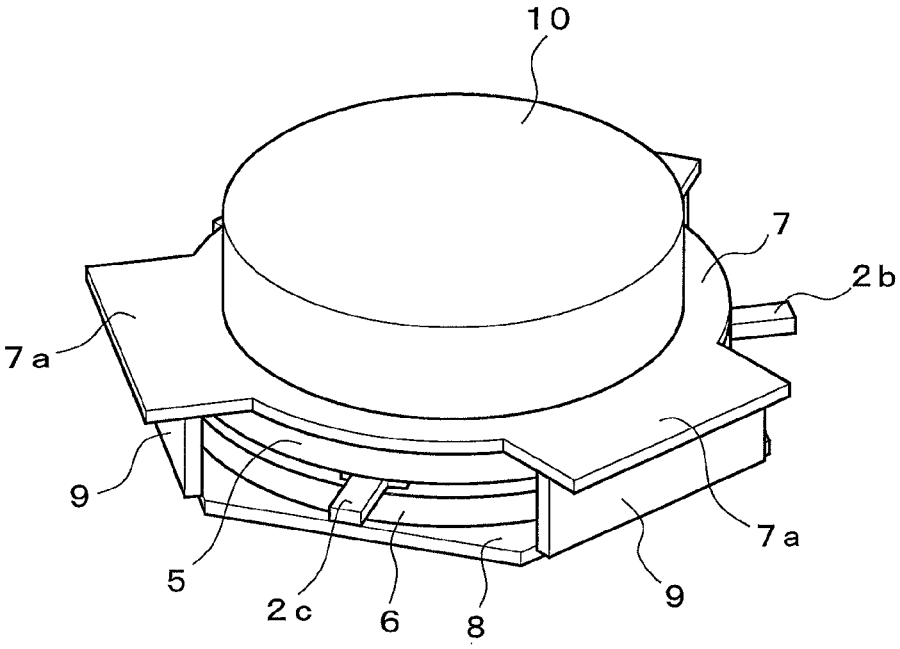
FIG. 1 is a perspective view showing a first embodiment of the present invention.
Figure 2:
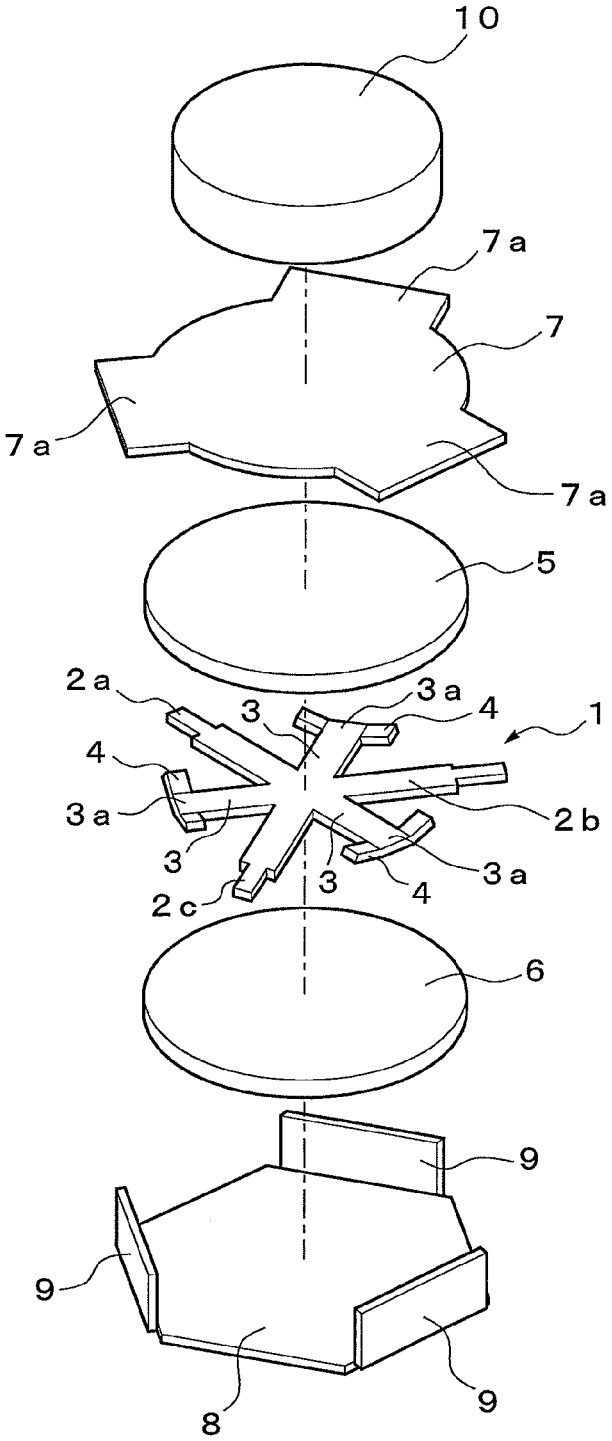
FIG. 2 is an exploded perspective view of FIG. 1.
Figure 3:
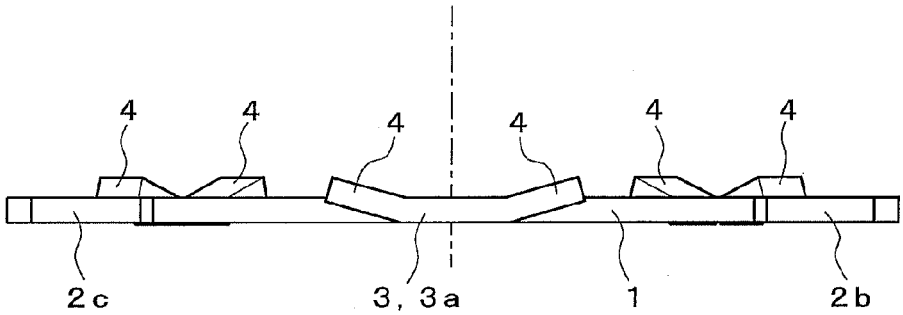
FIG. 3 is a front view showing a central conductor in FIG. 2.

FIGS. 1 to 4 show an embodiment in which a non-reciprocal circuit element according to the present invention is applied to an isolator. Reference numeral 1 denotes a central conductor.

The central conductor 1 is formed of a metal plate of, e.g., phosphor bronze, and I/O terminals 2*a*, 2*b*, and 2*c* which extend outward and radially from a central portion 1*a* in three respective directions are formed. The I/O terminals 2*a*, 2*b*, and 2*c* are formed so as to form a central angle of 120° with one another and have a generally Y-shape. A resonator 3 which similarly extends outward and radially is formed between each circumferentially adjacent two of the I/O terminals 2*a*, 2*b*, and 2*c*. Note that the resonators 3 are set to be smaller in linear dimension than the I/O terminals 2*a*, 2*b*, and 2*c*.

Each resonator 3 is formed in a T-shape by including protruding portions formed at a distal end portion 3*a* which protrude in two respective directions orthogonal to the direction in which the resonator 3 extends outward. Proximal end portions protruding from the distal end portion 3*a* of the protruding portions are bent upward in FIG. 2 in respective out-of-plane directions, and the protruding portions become bent portions 4.

The central conductor 1 is held between an upper ferrite plate 5 and a lower ferrite plate 6.

The upper and lower ferrite plates 5 and 6 are formed such that their radii are smaller than linear dimensions from a center of the central conductor 1 to distal ends of the I/O terminals 2*a*, 2*b*, and 2*c* and are larger than linear dimensions from the center of the central conductor 1 to distal ends of the resonators 3.

An upper magnetic metal plate 7 and a lower magnetic metal plate 8 are disposed on an upper surface and a lower surface, respectively, of the upper and lower ferrite plates 5 and 6 with the central conductor 1 sandwiched therebetween. The lower magnetic metal plate 8 is formed into a flat plate of substantially hexagonal shape in appearance and is sized such that an inscribed circle of the lower magnetic metal plate 8 is slightly larger than the radius of the lower ferrite plate 6. A side plate 9 is integrally provided upright at every other edge of the hexagonal lower magnetic metal plate 8.

The upper magnetic metal plate 7 is formed into a disc approximately equal in radius to the upper ferrite plate 5, and joints 7*a* which protrude squarely are further formed at a peripheral portion with a central angle of 120° therebetween. Note that the width dimension of each joint 7*a* is set to the linear dimension of each side plate 9 of the lower magnetic metal plate 8.

The central conductor 1 and the upper and lower ferrite plates 5 and 6 are housed inside the side plates 9 on the lower magnetic metal plate 8, and the upper magnetic metal plate 7 is stacked on the upper surface of the upper ferrite plate 5. Upper edges of the side plates 9 of the lower magnetic metal plate 8 abut on lower surfaces of the joints 7*a* of the upper magnetic metal plate 7. A permanent magnet 10 in the form of a circular plate is placed on the upper magnetic metal plate 7 and is fixed with adhesive or the like. The permanent magnet 10 is intended to generate a fixed field system at the upper and lower ferrite plates 5 and 6 in a direction orthogonal to plate surfaces of the upper and lower ferrite plates 5 and 6.

Figure 4:
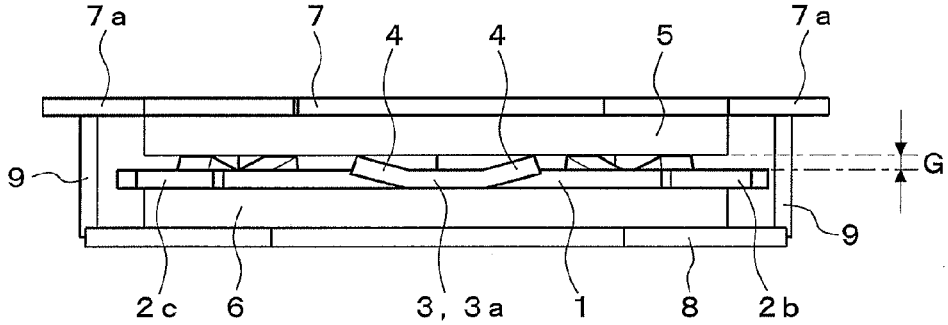
FIG. 4 is a front view of FIG. 1.

With this configuration, the central conductor 1, the upper and lower ferrite plates 5 and 6, the upper and lower magnetic metal plates 7 and 8, and the permanent magnet 10 are mechanically, magnetically, and electrically stacked, the upper and lower magnetic metal plates 7 and 8 form a closed magnetic circuit via the side plates 9, and an interstice G is formed between an upper surface of the central conductor 1 and a lower surface of the upper ferrite plate 5 by the bent portions 4 formed at the distal ends of the resonators 3 of the central conductor 1, as shown in FIG. 4. Note that the amount of bending of the bent portions 4 is adjusted such that the interstice G is not more than about 0.15 mm.

The isolator with the above-described configuration as a whole is, for example, a component about 10 to 20 mm square and about 5 mm high. Of the I/O terminals 2*a*, 2*b*, and 2*c*, the I/O terminal 2*a* is set as an input terminal, the I/O terminal 2*b* is set as an output terminal, and the other I/O terminal is grounded. The isolator is mounted on a circuit board (not shown). In this manner, the isolator is incorporated as a part of a microwave circuit.

Microwaves applied to the input terminal 2*a* generate a high-frequency field in the central conductor 1. The traveling direction of the microwaves is bent by magnetic moments in the upper and lower ferrite plates 5 and 6, and the microwaves are rotated clockwise by a central angle of 120° and output to the output terminal 2*b*. The microwaves introduced to the output terminal 2*b* are rotated clockwise by a central angle of 120° and output to the I/O terminal 2*c* and are grounded.

Additionally, in the isolator with the above-described configuration, the bent portions 4 bent in the out-of-plane directions are formed at the distal end portions 3*a* of the resonators 3 of the central conductor 1 to form the interstice G between the central conductor 1 and the upper ferrite plate 5, and the upper ferrite plate 5 is provided to be capable of coming into and out of contact with the central conductor 1 due to the elasticity of the bent portions 4. Accordingly, even if bending stress acts on the circuit board after the isolator is mounted to cause warpage, the warpage can be absorbed in the interstice G by elastic deformation of the bent portions 4.

As a result, fracture of the upper and lower ferrite plates 5 and 6 is prevented by the flexibility even in the presence of bending stress acting on the circuit board after the mounting, which allows achievement of height reduction by thinning of the upper and lower magnetic metal plates 7 and 8. It is thus possible to easily achieve height reduction and size reduction.

Moreover, errors in the thickness dimensions of the upper and lower ferrite plates 5 and 6 generated at the time of machining can be absorbed by finely adjusting the dimension of the interstice G. Thus, processing margins are secured, which leads to superiority in mass productivity. It is also possible to change or finely adjust a center frequency by changing the capacitances between the resonators 3 of the central conductor 1 and the components above and below the central conductor 1 by appropriate prior adjustment of the dimension of the interstice G.

Figure 6A:
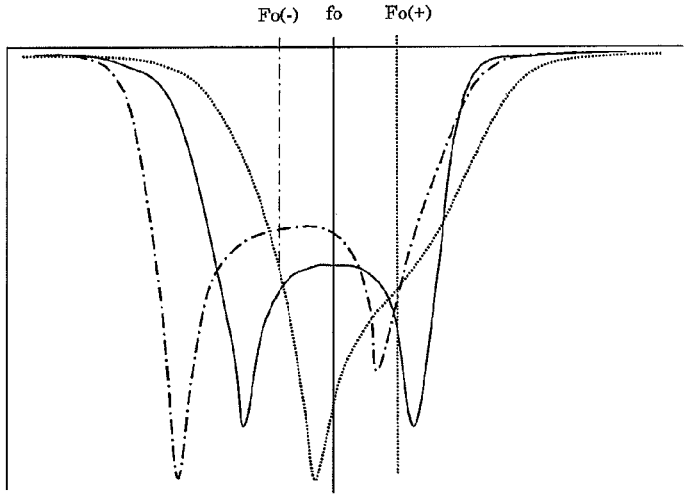
FIG. 6A schematically shows change in center frequency due to temperature change and is a graph showing change in center frequency resulting from change in interstice dimension due to temperature change.

As shown in FIG. 6A, in the isolator, the dimension of the interstice G increases due to thermal elongation of the side plates 9 made of magnetic metal with increase in temperature. As a result of the increase in the interstice G, the capacitances between the components and the resonators 3 decrease, which shifts the center frequency toward the high frequency side (the Fo(+) side) on the right of FIG. 6A.

Figure 6B:
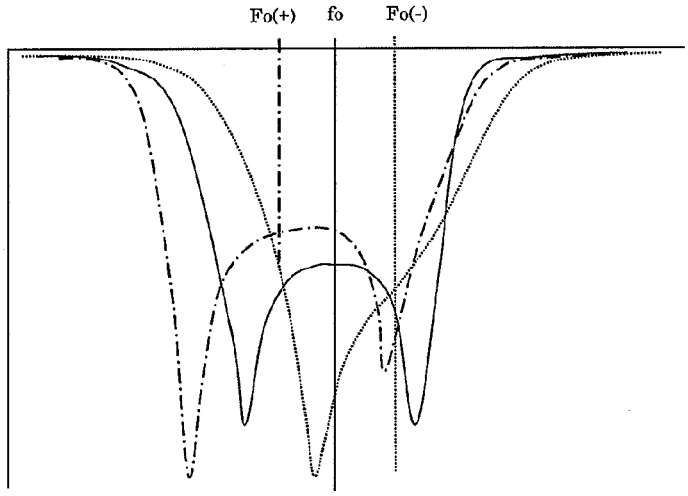
FIG. 6B is like FIG. 6A and is a graph showing change in center frequency resulting from change in magnetic flux density due to temperature change.

In contrast, as shown in FIG. 6B, the permanent magnet 10 and the upper and lower magnetic metal plates 7 and 8 decrease in magnetic field strength (magnetic flux density) with increase in temperature. The decrease in magnetic field strength tends to shift the center frequency toward the low frequency side (the Fo(−) side) on the right of FIG. 6B.

For this reason, in the isolator with the interstice G formed between the central conductor 1 and the upper ferrite plate 5, in the event of a temperature change, change in center frequency resulting from change in the magnetic field strengths of the permanent magnet 10 and the upper and lower magnetic metal plates 7 and 8 and change in center frequency resulting from change in the dimension of the interstice G due to thermal elongation of the side plates 9 cancel each other out. This allows achievement of superior temperature characteristics.

Figure 5:
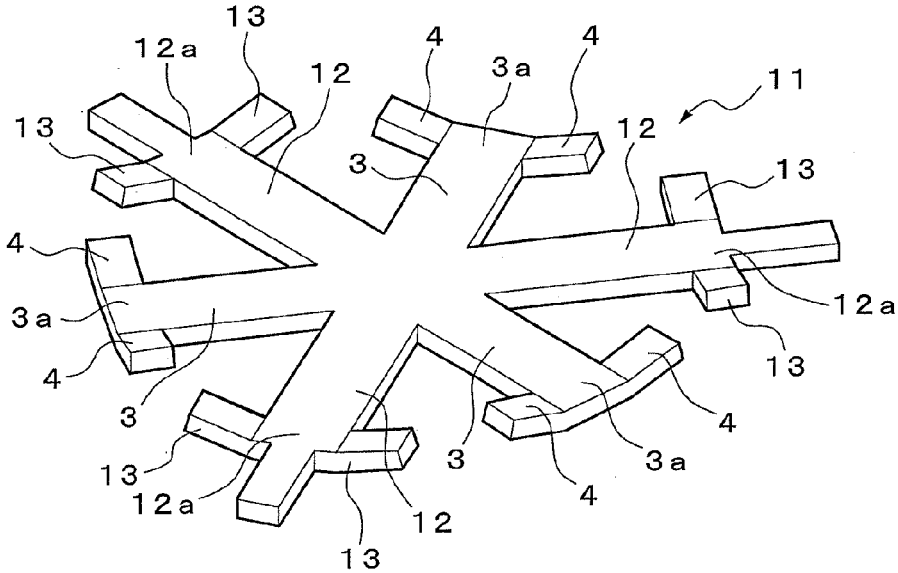
FIG. 5 is a perspective view showing a central conductor according to another embodiment of the present invention.

FIG. 5 shows a central conductor in a modification in which a non-reciprocal circuit element according to the present invention is applied to an isolator. The other components are the same as those shown in FIGS. 1 to 4. The same reference numerals will be used below to simplify a description of the components.

In the isolator, a distal end portion 12*a* of an I/O terminal 12 of a central conductor 11 is formed in a T-shape by including protruding portions which protrude in two respective directions orthogonal to the direction in which the I/O terminal 12 extends. Second bent portions 13 are formed by bending proximal end portions of the protruding portions toward the upper ferrite plate 5 in respective out-of-plane directions.

The second bent portions 13 are set to have an amount of bending approximately equal to that of each bent portion 4 formed at the distal end portion 3*a* of the resonator 3. With the setting, the second bent portions 13 are elastically deformed in cooperation with the bent portions 4 when the whole of the isolator is subjected to bending stress.

As a result, in the isolator including the central conductor 11, the similar second bent portions 13 that cooperate with the bent portions 4 of the resonators 3 are formed at the distal end portions 12*a* of three I/O terminals 12 which extend radially between the resonators 3, in addition to the bent portions 4 at the distal end portions 3*a* of the three resonators 3. For this reason, the central conductor 11 and the upper ferrite plate 5 abut on each other at 12 points in six spots in a circumferential direction.

Thus, the isolator according to the present modification can more reliably form the interstice G that is uniform in the circumferential direction, in addition to obtaining the same working effects as those of the isolator shown in FIGS. 1 to 4. This allows achievement of more stable frequency characteristics. The isolator can also obtain the effect of eliminating the causes of variations in return loss characteristics and isolation characteristics and stabilizing the characteristics.

Note that although the above-described modification has described only a case where the interstice G is formed between the upper surface of the central conductor 1 and the upper ferrite plate 5 by bending the distal end portions 3*a* of the resonators 3 of the central conductor 1 or the distal end portions 12*a* of the I/O terminals 12 toward the upper ferrite plate 5 in out-of-plane directions to form the bent portions 4 and 13, the present invention is not limited to this. A similar interstice may be formed between the central conductor 1 and the lower ferrite plate 6 by oppositely bending the distal end portions toward the lower ferrite plate 6. Alternatively, respective interstices may be formed between the central conductor 1 and the upper and lower ferrite plates 5 and 6 by bending the distal end portions alternately toward the upper and lower ferrite plates 5 and 6.

Second Embodiment

Figure 7:
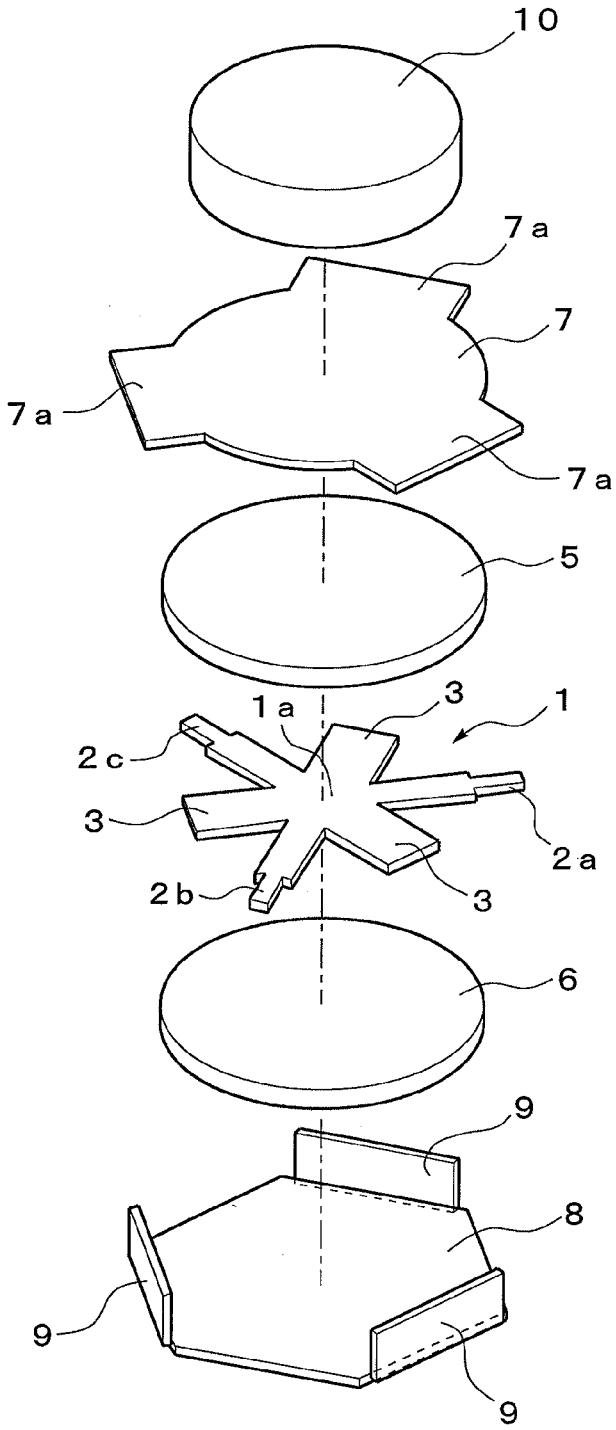
FIG. 7 is an exploded perspective view showing a second embodiment of the present invention.
Figure 8:
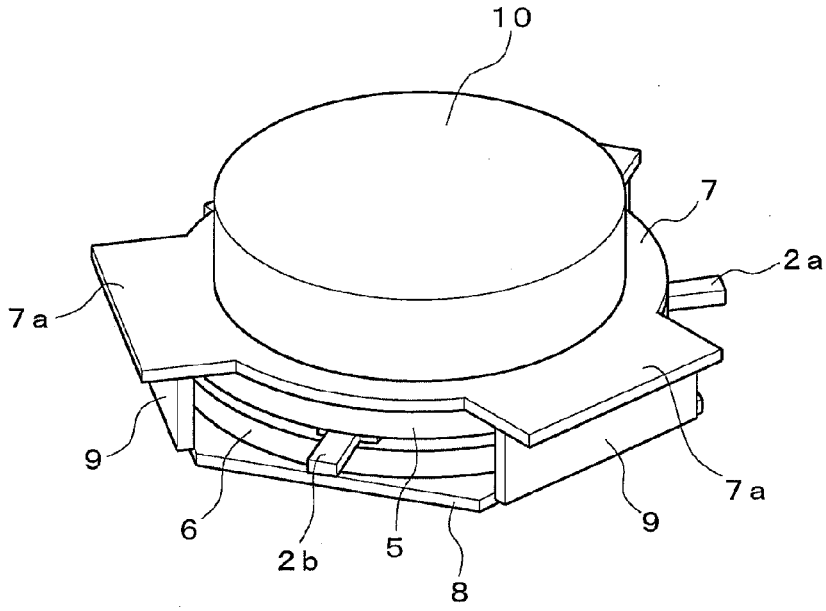
FIG. 8 is a perspective view showing a state in which components in FIG. 7 are assembled.
Figure 9:
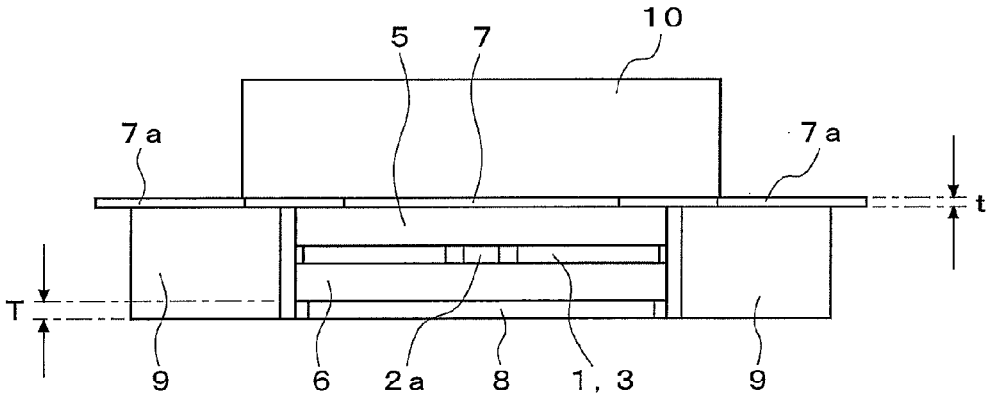
FIG. 9 is a front view of FIG. 8.

FIGS. 7 to 9 show a second embodiment in which a non-reciprocal circuit element according to the present invention is applied to an isolator. Like the above-described first embodiment, reference numeral 1 denotes a central conductor.

The central conductor 1 is formed of a metal plate of, e.g., phosphor bronze, and I/O terminals 2*a*, 2*b*, and 2*c* which extend outward and radially from a central portion 1*a* in three respective directions are formed. The I/O terminals 2*a*, 2*b*, and 2*c* are formed so as to form a central angle of 120° with one another and have a generally Y-shape. A resonator 3 which similarly extends outward and radially is formed between each circumferentially adjacent two of the I/O terminals 2*a*, 2*b*, and 2*c*. Note that the resonators 3 are set to be smaller in linear dimension than the I/O terminals 2*a*, 2*b*, and 2*c*.

The central conductor 1 is held between an upper ferrite plate 5 and a lower ferrite plate 6.

The upper and lower ferrite plates 5 and 6 are formed such that their radii are smaller than linear dimensions from a center of the central conductor 1 to distal ends of the I/O terminals 2*a*, 2*b*, and 2*c* and are larger than linear dimensions from the center of the central conductor 1 to distal ends of the resonators 3.

An upper magnetic metal plate 7 and a lower magnetic metal plate 8 are disposed on an upper surface and a lower surface, respectively, of the upper and lower ferrite plates 5 and 6 with the central conductor 1 sandwiched therebetween. The lower magnetic metal plate 8 is a flat plate made of pure iron which is formed in a substantially hexagonal shape in appearance and is sized such that an inscribed circle of the lower magnetic metal plate 8 is slightly larger than the radius of the lower ferrite plate 6. A side plate 9 is integrally provided upright at every other edge of the hexagonal lower magnetic metal plate 8.

The upper magnetic metal plate 7 is formed of magnetic stainless steel having magnetic permeability lower than that of pure iron, and a central portion thereof is formed into a disc approximately equal in diameter to the upper ferrite plate 5. Joints 7*a* which protrude squarely are further formed at respective positions which form a central angle of 120° with one another of a peripheral portion. Note that the width dimension of each joint 7*a* is set to the linear dimension of each side plate 9 of the lower magnetic metal plate 8.

The upper and lower ferrite plates 5 and 6 with the central conductor 1 sandwiched therebetween are housed inside the side plates 9 on the lower magnetic metal plate 8, and the upper magnetic metal plate 7 is stacked on the upper surface of the upper ferrite plate 5.

Upper edges of the side plates 9 of the lower magnetic metal plate 8 abut on lower surfaces of the joints 7*a* of the upper magnetic metal plate 7. A magnet 10 which is composed of a permanent magnet in the form of a circular plate is placed on the upper magnetic metal plate 7 and is fixed with adhesive or the like. The magnet 10 is intended to generate a fixed field system at the upper and lower ferrite plates 5 and 6 in a direction orthogonal to plate surfaces of the upper and lower ferrite plates 5 and 6.

With this configuration, the central conductor 1, the upper and lower ferrite plates 5 and 6, the upper and lower magnetic metal plates 7 and 8, and the magnet 10 are mechanically, magnetically, and electrically stacked, and the upper and lower magnetic metal plates 7 and 8 form a closed magnetic circuit via the side plates 9.

In the isolator, the upper magnetic metal plate 7 has a thickness t smaller than a thickness T of the lower magnetic metal plate 8, as shown in FIG. 9. For example, if the thickness T of the lower magnetic metal plate 8 is set to 0.3 mm, the thickness t of the upper magnetic metal plate 7 is set to 0.15 mm, one half of the thickness T.

The isolator with the above-described configuration as a whole is, for example, a component about 10 to 20 mm square and about 5 mm high. Of the I/O terminals 2*a*, 2*b*, and 2*c*, the I/O terminal 2*a* is set as an input terminal, the I/O terminal 2*b* is set as an output terminal, and the other I/O terminal is grounded. The isolator is mounted on a circuit board (not shown). In this manner, the isolator is incorporated as a part of a microwave circuit.

Microwaves applied to the input terminal 2*a* generate a high-frequency field in the central conductor 1. The traveling direction of the microwaves is bent by magnetic moments in the upper and lower ferrite plates 5 and 6, and the microwaves are rotated clockwise by a central angle of 120° and output to the output terminal 2*b*. The microwaves introduced to the output terminal 2*b* are rotated clockwise by a central angle of 120° and output to the I/O terminal 2*c* and are grounded.

Additionally, in the isolator with the above-described configuration, the closed magnetic circuit formed by the upper and lower magnetic metal plates 7 and 8 and the side plates 9 stably holds magnetism from the permanent magnet 10, and the upper magnetic metal plate 7, on which the magnet 10 is placed, is formed of magnetic stainless steel having magnetic permeability lower than that of pure iron and is formed to have the thickness t smaller than the thickness T of the lower magnetic metal plate 8. This allows enhancement of the strength of a leakage magnetic field propagated from the magnet 10 to the upper ferrite plate 5 through the upper magnetic metal plate 7.

In addition, the magnetic field together with a magnetic field supplied from the upper magnetic metal plate 7 via the side plates 9 is uniformly distributed over the resonators 3 in the central conductor 1. This allows obtainment of a good magnetic moment phenomenon. Moreover, since the magnet 10 is placed on the upper magnetic metal plate 7, i.e., outside the closed magnetic circuit, the upper and lower ferrite plates 5 and 6 have different magnetic field strength distributions. This results in a difference between the resonance frequencies at the upper and lower ferrite plates 5 and 6, which allows increase of a fractional band width.

For this reason, good circulator characteristics can be obtained without excessively increasing the magnetic field strength of the magnet 10, and the isolator can be used in a wide band including a high frequency band in particular. Additionally, since the upper magnetic metal plate 7 is formed of magnetic stainless steel, and the thickness t of the upper magnetic metal plate 7 is made smaller than the thickness T of the lower magnetic metal plate 8, it is possible to easily respond to a demand for further reduction in the size and weight of surface mount devices.

FIGS. 10 to 13 show several modifications, in each of which a non-reciprocal circuit element according to the present invention is applied to an isolator. The other components are the same as those shown in FIGS. 7 to 9. The same reference numerals will be used below to simplify a description of the components.

Figure 10:
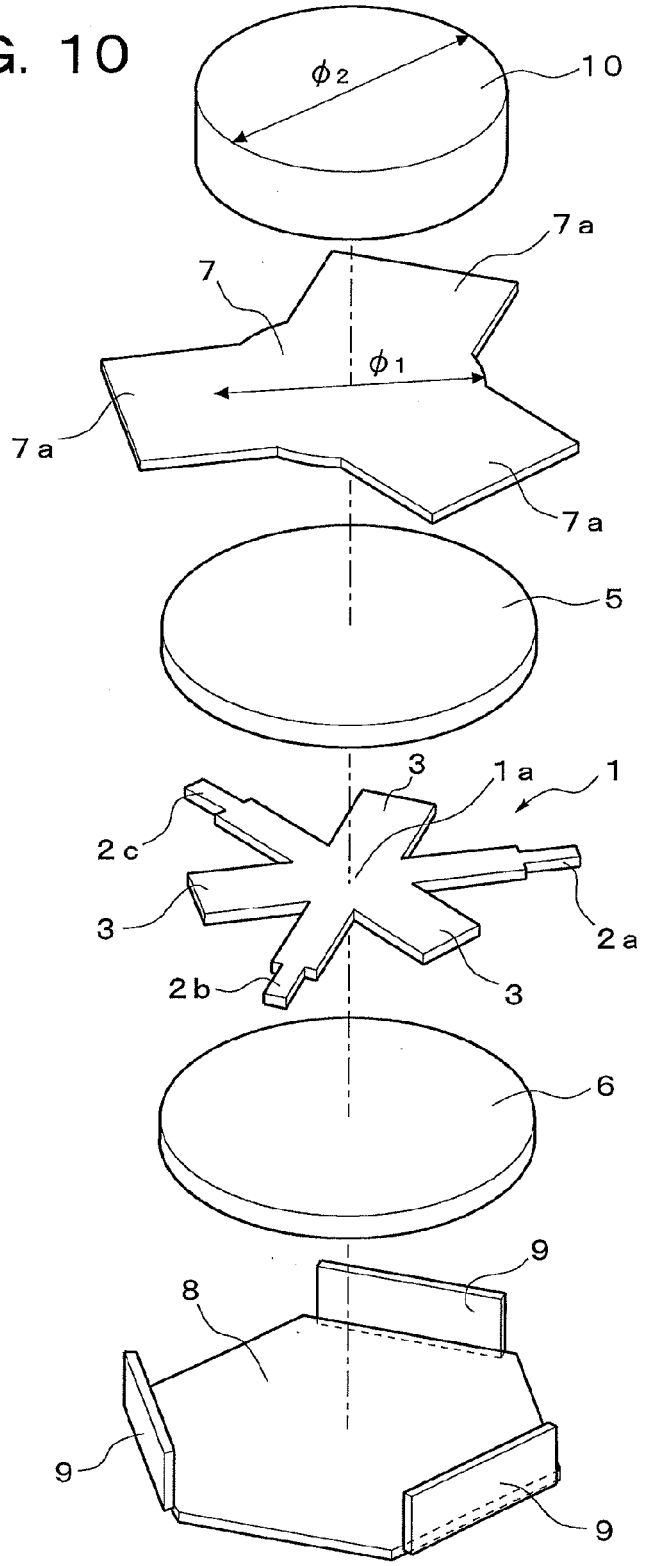
FIG. 10 is an exploded perspective view showing a modification of the second embodiment of the present invention.
Figure 11:
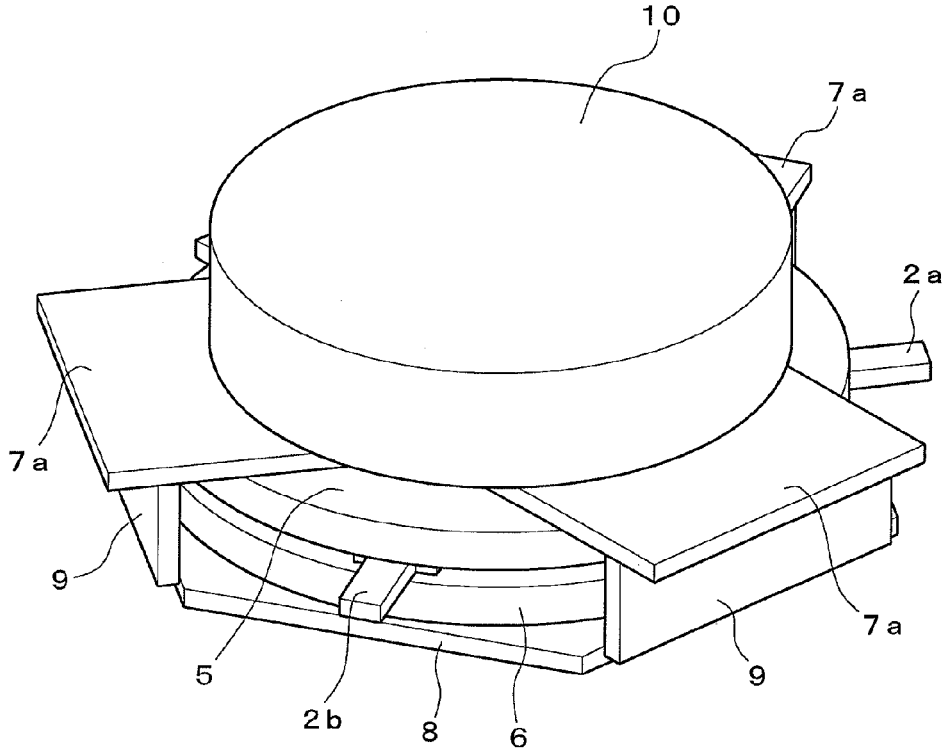
FIG. 11 is a perspective view showing a state in which components in FIG. 10 are assembled.

In an isolator according to a modification which is shown in FIGS. 10 and 11, a diameter ϕ1 in a central portion of the upper magnetic metal plate 7 is set to be smaller than that of the upper ferrite plate 5 and be smaller than a diameter ϕ2 of the magnet 10. With this configuration, between the joints 7*a*, parts of a peripheral portion of the magnet 10 protrude outward from a peripheral edge of the upper magnetic metal plate 7 and directly face the upper ferrite plate 5, as shown in FIG. 11.

Figure 12:
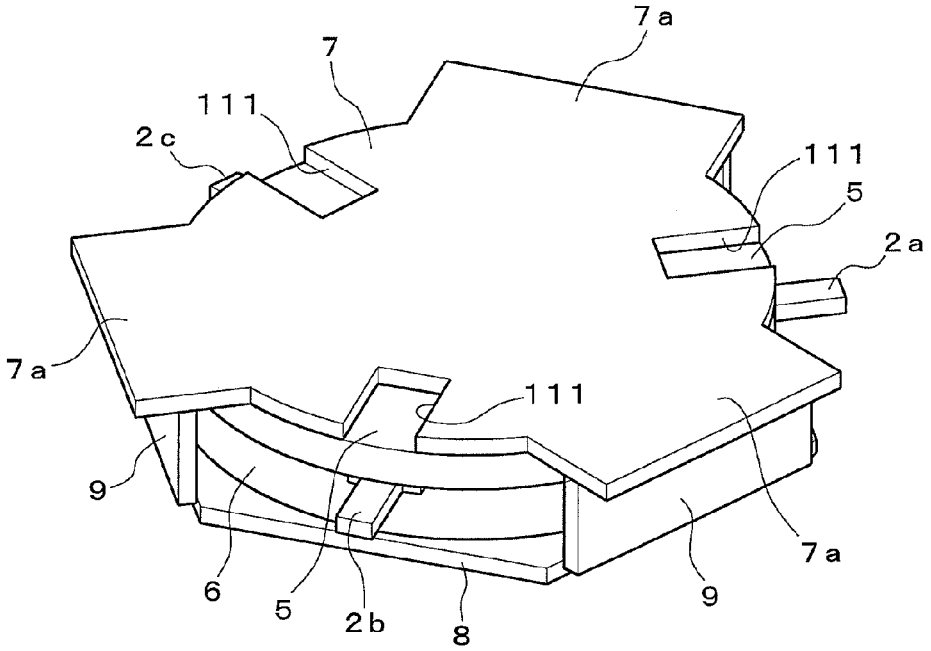
FIG. 12 is a perspective view showing another modification of the second embodiment of the present invention.

In an isolator according to another modification shown in FIG. 12, square notches 111 which extend toward a center are formed in a peripheral portion between the joints 7*a* in the upper magnetic metal plate 7. With this configuration, parts corresponding to the notches 111 of the peripheral portion of the magnet 10 directly face the upper ferrite plate 5 below the magnet 10 via the notches 111.

Figure 13:
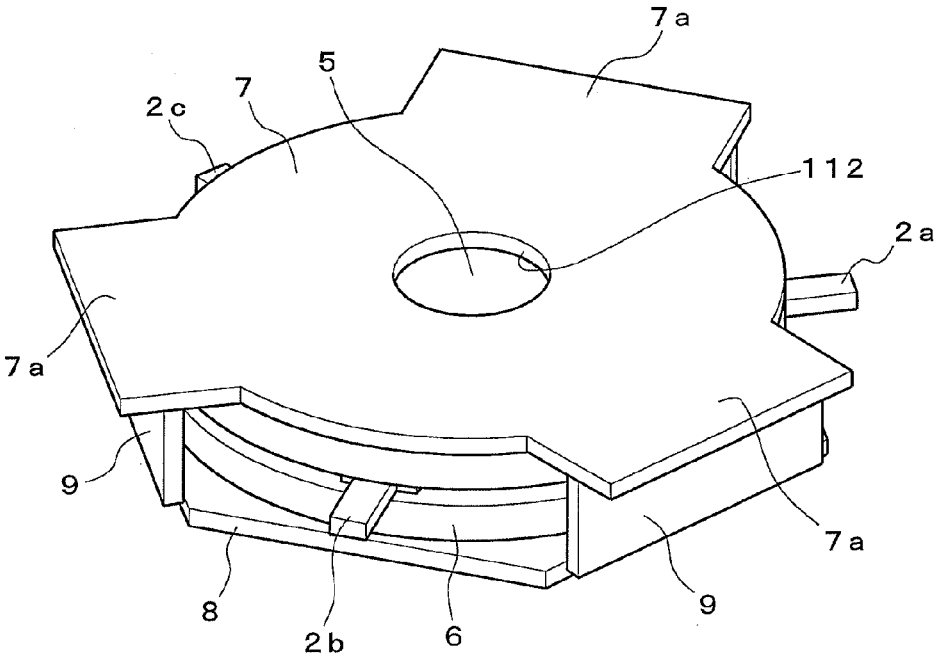
FIG. 13 is a perspective view showing still another modification of the second embodiment of the present invention.

In an isolator according to still another modification shown in FIG. 13, a circular opening 112 is formed in a central portion of the upper magnetic metal plate 7. With this configuration, a central portion corresponding to the opening 112 of the magnet 10 directly faces a central portion of the upper ferrite plate 5 below the magnet 10 via the opening 112.

Thus, the isolators according to the modifications of the second embodiment shown in FIGS. 10 to 13 can further strengthen a leakage magnetic field through the upper magnetic metal plate 7 due to the configurations in which a part of the magnet 10 directly faces the upper ferrite plate 5, in addition to obtaining the same working effects as those of the isolator shown in FIGS. 7 to 9. This allows use in a higher frequency band. The isolators can also obtain the effect of achieving expansion of an operation frequency range.

Note that although all of the second embodiment and the modifications thereof have described only a case where the upper magnetic metal plate 7 is formed of magnetic stainless steel having magnetic permeability lower than that of pure iron, of which the lower magnetic metal plate 8 is formed, and the thickness t of the upper magnetic metal plate 7 is set to be smaller than the thickness T of the lower magnetic metal plate 8, the present invention is not limited to this.

That is, the present invention may adopt a configuration in which the upper magnetic metal plate 7 is formed of a magnetic metal such as magnetic stainless steel having magnetic permeability lower than that of pure iron and the thicknesses of the upper and lower magnetic metal plates 7 and 8 are set to be equal or a configuration in which the upper magnetic metal plate 7 is formed of pure iron like the lower magnetic metal plate 8 and the thickness t of the upper magnetic metal plate 7 is set to be smaller than the thickness T of the lower magnetic metal plate 8.

As described above, the present application discloses a non-reciprocal circuit element which has a simple structure and superiority in assembly and allows easy achievement of height reduction and size reduction while preventing fracture of a ferrite plate. In the present invention, a central conductor 1 in which respective resonators 3 extending outward are formed between I/O terminals 2*a* to 2*c* extending outward in a Y-shape from a central portion, upper and lower ferrite plates 5 and 6 between which the central conductor 1 together with the resonators 3 is sandwiched, and upper and lower magnetic metal plates 7 and 8 between which the upper and lower ferrite plates are sandwiched are stacked, a magnet 10 is arranged on the upper magnetic metal plate 7, and bent portions 4 which are bent in out-of-plane directions and form an interstice G between the central conductor 1 and the upper ferrite plate 5 are formed at respective distal end portions 3*a* of the resonators 3 of the central conductor 1 such that the upper ferrite plate 5 is provided to be capable of coming into and out of contact with the central conductor 1 due to the elasticity of the bent portions 4. The prevent invention also provides a non-reciprocal circuit element which can obtain good circulator characteristics without excessively increasing the magnetic field strength of a magnet and can be used in a wide band including a high frequency band in particular. To this end, in a non-reciprocal circuit element in which the I/O terminals 2*a* to 2*c* are integrally formed, and the upper and lower magnetic metal plates 7 and 8 form a closed magnetic circuit via side plates 9, the upper magnetic metal plate 7 is formed of a material having magnetic permeability lower than that of pure iron and/or is formed to have a thickness t smaller than a thickness T of the lower magnetic metal plate 8.

The non-reciprocal circuit element according to any of the embodiments of the present invention can be used as an isolator, a circulator, or the like to be mounted on circuit boards of various microwave devices.

DESCRIPTION OF REFERENCE SYMBOLS

1, 11 central conductor
2*a*, 2*b*, 2*c*, 12 I/O terminal
3 resonator
3*a*, 12*a* distal end portion
4, 13 bent portion (protruding portion)
5 upper ferrite plate
6 lower ferrite plate
7 upper magnetic metal plate
8 lower magnetic metal plate
9 side plate
10 permanent magnet (magnet)
G interstice
111 notch
112 opening
t thickness of upper magnetic metal plate
T thickness of lower magnetic metal plate
ϕ1 diameter in central portion of upper magnetic metal plate
ϕ2 diameter of magnet

The invention claimed is:

1. A non-reciprocal circuit element in which a central conductor in the form of a flat plate in which respective resonators extending outward are formed between I/O terminals extending outward and radially from a central portion in three directions, upper and lower ferrite plates between which the central conductor together with the resonators is sandwiched, and upper and lower magnetic metal plates between which the upper and lower ferrite plates are sandwiched are stacked, a magnet is arranged on the upper magnetic metal plate, and the upper and lower magnetic metal plates form a closed magnetic circuit via a side plate, wherein bent portions which are bent in out-of-plane directions and form an interstice between the central conductor and the upper ferrite plate and/or the lower ferrite plate are formed at respective distal end portions of the resonators of the central conductor such that the upper ferrite plate and/or the lower ferrite plate is provided to be capable of coming into and out of contact with the central conductor due to elasticity of the bent portions.

2. The non-reciprocal circuit element according to claim 1, wherein a distal end portion of each of the I/O terminals is formed in a T-shape by including protruding portions which protrude in two directions orthogonal to a direction in which the I/O terminal extends outward, and a second bent portion which cooperates with the bent portions is formed by bending a proximal end portion of each of the protruding portions.

3. The non-reciprocal circuit element according to claim 1, wherein the central conductor is made of a copper-based non-magnetic metal plate.

4. The non-reciprocal circuit element according to claim 3, wherein a distal end portion of each of the I/O terminals is formed in a T-shape by including protruding portions which protrude in two directions orthogonal to a direction in which the I/O terminal extends outward, and a second bent portion which cooperates with the bent portions is formed by bending a proximal end portion of each of the protruding portions.

5. The non-reciprocal circuit element according to claim 1, wherein the distal end portion of each of the resonators is formed in a T-shape by including protruding portions which protrude in two directions orthogonal to a direction in which the resonator extends outward, and the bent portion is formed by bending a proximal end portion of each of the protruding portions.

6. The non-reciprocal circuit element according to claim 5, wherein the central conductor is made of a copper-based non-magnetic metal plate.

7. The non-reciprocal circuit element according to claim 5, wherein a distal end portion of each of the I/O terminals is formed in a T-shape by including protruding portions which protrude in two directions orthogonal to a direction in which the I/O terminal extends outward, and a second bent portion which cooperates with the bent portions is formed by bending a proximal end portion of each of the protruding portions.

* * * * *